United States Patent [19]

Carbonnel

[11] 4,061,176

[45] Dec. 6, 1977

[54] FLUID-TIGHT COLD-CHAMBER PRESSURE CASTING APPARATUS

[75] Inventor: Henri Carbonnel, Antony, France

[73] Assignee: Groupement pour les Activites Atomiques et Avancees "GAAA" S.A., Le Plessis-Robinson, France

[21] Appl. No.: 708,449

[22] Filed: July 26, 1976

[30] Foreign Application Priority Data

Aug. 8, 1975 France ..... 75.24830

[51] Int. Cl.[2] ..... B22D 17/14

[52] U.S. Cl. ..... 164/61; 164/256; 164/312

[58] Field of Search ..... 164/61, 65, 253, 254, 164/256, 258, 312, 257, 147

[56] References Cited

U.S. PATENT DOCUMENTS

| | | | |
|---|---|---|---|
| 2,985,928 | 5/1961 | Heskett | 164/257 |
| 4,030,538 | 6/1977 | Carbonnel | 164/312 |

*Primary Examiner*—Robert D. Baldwin

*Attorney, Agent, or Firm*—Sughrue, Rothwell, Mion, Zinn and Macpeak

[57] ABSTRACT

Apparatus comprising a crucible, a level-determining tank, a vacuum pump, an injection cylinder, a mould and appropriate interconnecting pipes. Molten metal is kept under vacuum throughout except that in a modification a gas may be deliberately introduced into the mould to provide a surface treatment of the casting.

7 Claims, 5 Drawing Figures

FLUID-TIGHT COLD-CHAMBER PRESSURE CASTING APPARATUS

BACKGROUND OF THE INVENTION

1. Field of the Invention

The present invention relates to a fluid-tight molten metal casting device on a pressure moulding machine applicable to casting in contact with a gas or in a vacuum.

2. Description of the Prior Art

A known pressure casting installation of an industrial kind comprises: a holding furnace or a crucible containing the molten metal to be cast and a means for injecting the molten metal typically constituted by a cylinder provided with a piston. Means such as a supply pipe for feeding the cylinder brings the molten metal from the crucible into the injection cylinder. For low pressure casting, the means for injecting the metal in the mould and the feed means can be combined.

At present, a known device for adjusting the casting on machines for moulding under pressure with a cold chamber comprises:

A crucible containing the molten metal arranged below and to one side of a mould, a pump immersed in the molten metal, an ascending mould feed pipe, a junction on the supply pipe, a level determining tank connected to a return pipe for returning the molten metal to the crucible.

In this device, the said junction connects the level-determining tank to the feed pipe and thus determines at all points of the latter a level of metal defined with precision.

When the metal to be cast is particularly reactive, for example in contact with atmospheric oxygen, it appeared desirable to constitute a casting device which is sufficiently fluid-tight for the filling of the mould to be possible in contact with a predetermined gas or else in a vacuum.

When a vacuum has been set up in the mould by means of a vacuum pump, a part reproducing with great exactitute the finest designs of the mould is obtained.

When the mould undergoes subsequent filling by means of a gas having a suitable composition, surface treatment can be effected on the part during casting.

In any case, the maintaining in a vacuum of the crucible containing the metal during the casting operations ensures appreciable degassing of the metal to be cast.

SUMMARY OF THE INVENTION

The present invention provides a fluid-tight cold chamber pressure casting apparatus comprising:

A mould;

A crucible closed by a cover, said crucible containing molten metal in operation of the apparatus;

A pump for molten metal which is at least partly immersed in the said molten metal;

An ascending feed pipe rising from the pump for molten metal;

A level-determining tank connected to a return pipe for returning the molten metal to the crucible as well as to the ascending feed pipe;

An injection cylinder supplied with molten metal by the ascending feed pipe and connected to the mould;

and a vacuum pump connected to the crucible, the level-determining tank and the injection cylinder for maintaining a vacuum above molten metal therein.

Thus, at the time of the feeding of the injection cylinder, the feed level of the said cylinder is determined with great precision by the pre-adjusted level of the level-determining tank, this making it possible to supply the quantity of metal with the repeated precision. Further the metal injected into the mould is degassed and free from corrosive action.

If it is required to effect at the same time a chemical treatment of the surface, a pre-adjusted quantity of reactive gas may be injected into the mould from a suitable gas supply during the filling of the injection cylinder. The molten metal will come into contact with the reactive gas on its injection into the mould.

Embodiments of the invention will be described hereinbelow by way of example with reference to the accompanying drawings.

Figure 1:
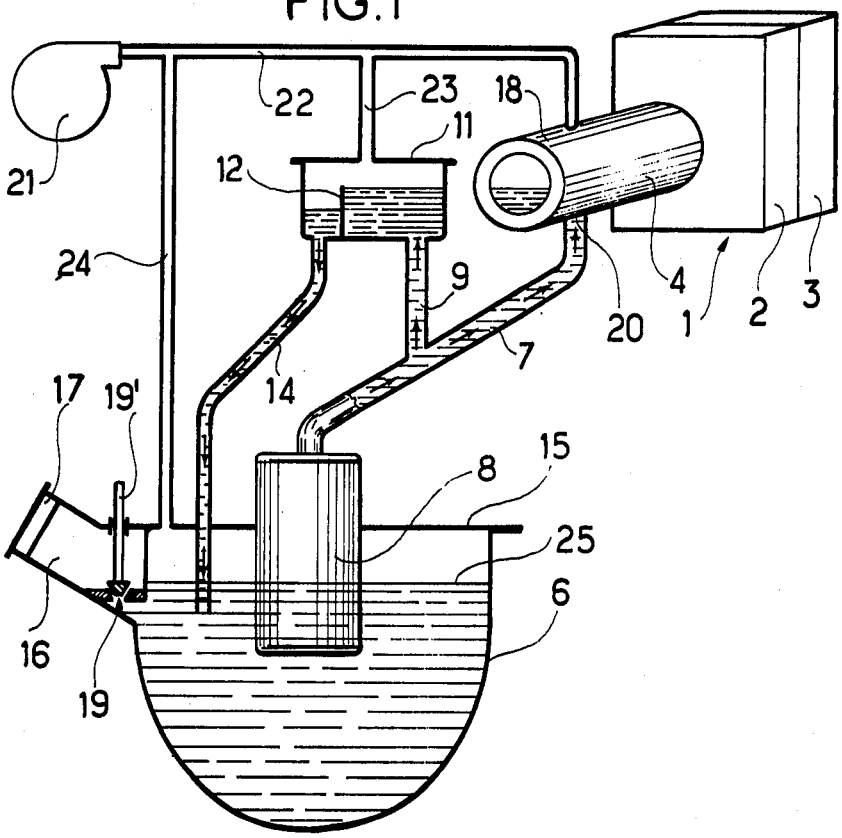
FIG. 1 is a general diagram in partial cross-section of an installation operating exclusively with a vacuum.

On referring to FIG. 1, a mould 1 is formed by a fixed part 2 and by a removable part 3. The parts are assembled to be substantially vacuum-tight by means of an O ring 5 (see FIG. 2).

An injection cylinder 4 is connected by any suitable known means to the fixed part 2 of the mould 1.

The injection cylinder 4 is connected to a crucible 6 by means of an ascending pipe 7 and of a pump 8. The pump 8 is preferably an electromagnetic pump whose discharge rate can easily be adjusted by varying the applied voltage. The pipe 7 has a branch 9 feeding a level-determining tank 11. The latter comprises an overflow 12 fitted with a central lip. The overflow 12 can slide in relation to the walls of the level-determining tank 11 and thus ensure an adjustable level of molten metal in the tank. The waste flows towards the crucible 6 through a return pipe 14.

The crucible 6 is closed by a sealed cover 15. The passages of the pipes 7 and 14 are fitted with sealing rings. The filling of the crucible is effected through a supply pipe 16 closed by a sealed stopper 17 and provided with a passage 19 which can be stopped by means of a stopper rod 19'.

The injection cylinder 4 comprises a piston (not illustrated in this figure) situated in the rest position in a region 18 upstream from an inlet 20 of the ascending pipe 7 in the said injection cylinder 4.

A vacuum pump 21 is connected to the injection cylinder by a pipe 22 communicating with the injection cylinder opposite the inlet 20 of the ascending pipe 7. This pipe 22 coming from the vacuum pump 21 is also connected to the level-determining tank 11 by a branch 23 passing through a fluid-tight cover thereof. Another branch 24 is connected to the pipe 22 and communicates through the cover 15 of the crucible 6 above the level 25 of the molten metal. The seal between the tubing and the cover 15 through which it passes is ensured by a sealing ring (not shown). The mould is provided with a sealing ring, the various pipes being sealed and being connected in a fluid-tight manner to the spaces which they empty, a vacuum having very substantially the same pressure is set up both at the surface of the molten metal 15 in the crucible as in the level tank 11, in the injection cylinder 4 and in the mould 1 when the vacuum pump 21 is in action. Thus, when the immersed liquid metal pump 8 is started up, the level of the molten metal within the injection cylinder will be defined by the height of the overflow 12 whatever the pressure applied by the vacuum pump 21 and the discharge of the immersed pump 8 may be.

It should be observed that the free space in the crucible above the molten metal, the pipe 7, the pipe 22, constitute a reserve vacuum which enables the very rapid setting up of a vacuum in the mould before the filling of the latter.

Figure 2:
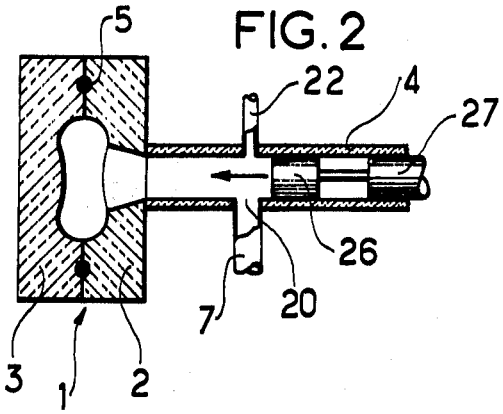
FIG. 2 is a cross-section showing the position of the piston in the injection cylinder during vacuum pumping.

FIG. 2 is a cross-section of the mould 2 and of the injection cylinder 4 in which is seen with the piston 26 in its position for setting up the vacuum in the mould. The gas contained in the mould is sucked firstly into the pipe 22 of the vacuum pump and secondly into the large cross-section pipe 7. The piston 26 is integral with a second pistion 27 actuated by a jack (not shown). When the required vacuum is reached, the level of the tank 11 is definite and the predetermined quantity of molten metal enters the injection cylinder through the pipe 7.

Figure 3:
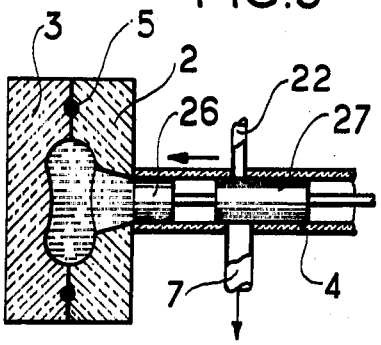
FIG. 3 is similar to FIG. 2 and shows the moulding operation.

FIG. 3 corresponds to the moulding phase. The piston 26 is brought into action. The sliding of the second piston 27 isolates the pipe 2 from the vacuum and the molten metal feed pipe 7. The electromagnetic pump 8 interrupts the pressure applied to the molten metal column which falls back into the crucible. The pipe 7 and the level tank 11 are emptied. The vacuum pump continues to feed the tank 12 through the pipe 23 and the surface of the molten metal contained in the crucible 6 through the pipe 24. The degassing of the molten metal continues.

The piston 26 pushes the predetermined quantity of molten metal contained in the injection cylinder and injects it into the mould while the piston 27 keeps the pipes 22 and 7 closed.

Figure 4:
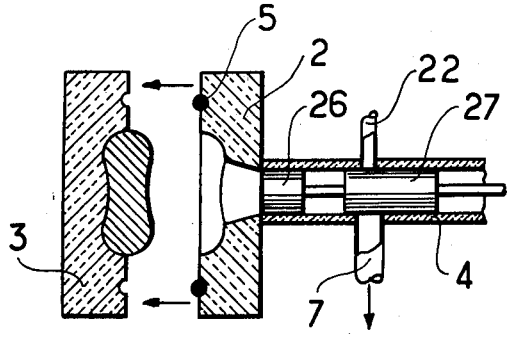
FIG. 4 is similar to FIGS. 2 and 3 shows the extraction of the moulded part.

FIG. 4 corresponds to the extraction of the moulded part.

When the cooling of the moulded part is sufficient, the two parts of the mould are separated. The mobile part 3 of the mould moves backwards, revealing the moulded part. If the moulded part remains stuck to the fixed part of the mould 2, a forward movement of the piston 26 will enable the moulded part to be removed from the fixed part 2 of the mould. It should be noted that whereas the mould remains open, the part 27 of the piston continues to stop the outlets of the pipes 22 and 7 so that the vacuum continues to prevail in the remainder of the device and more particularly in the crucible 6.

Figure 5:
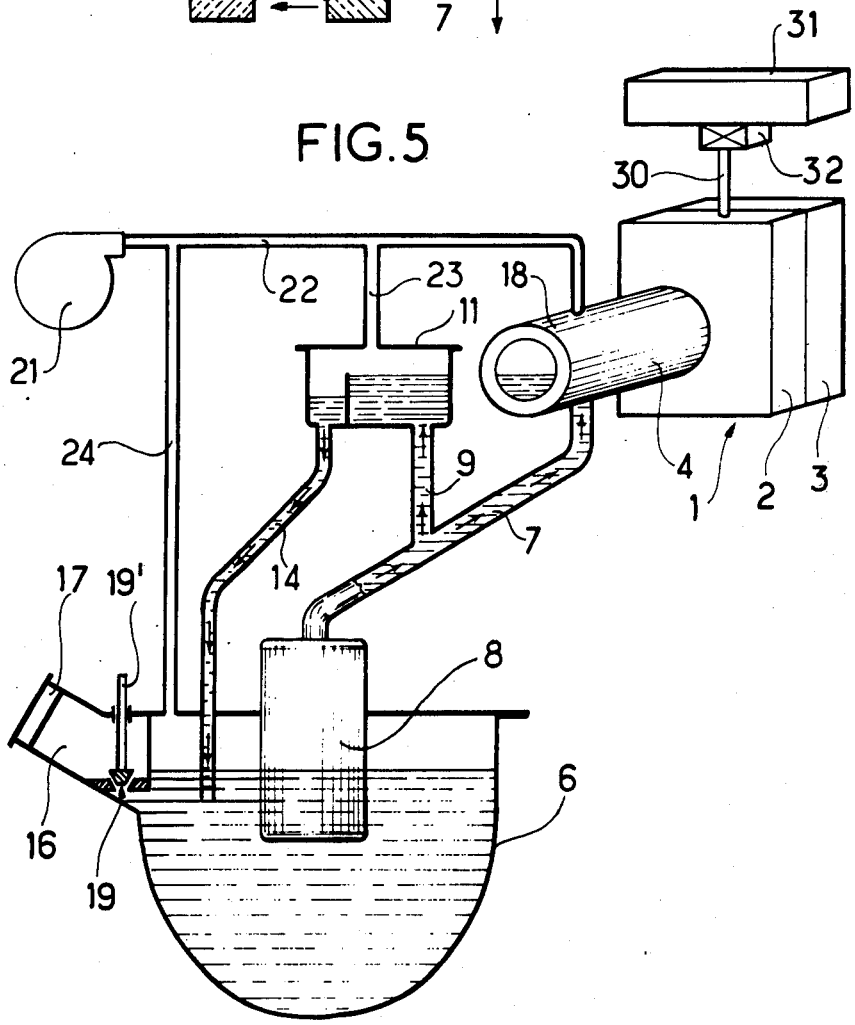
FIG. 5 is a view similar to FIG. 1 showing an installation in the case where a gas is injected in the mould at the time of the filling of the injection cylinder.

FIG. 5 relates to a variant of the device comprising a source of injection into the mould of a gas at a predetermined pressure.

The device remains the same as described previously with reference to FIGS. 1, 2 and 3. The fixed part 2 of the mould 1 further includes an inlet of a pipe 30 making the mould communicate with a gas source 31 through a valve 32. The operation is effected as follows: when the vacuum is set up in the mould, the pumping of the metal by the electromagnetic pump fills the chamber of the injection cylinder up to a predetermined level defined by the position of the overflow 12. It is then possible to make the mould communicate with the gas source 31 by operating the valve 32 and thus to ensure that the gas is let into the mould. The gas injection valve will be closed when the piston 26 which stops firstly the pipes 7 and 22 and begins to push the molten metal into the mould.

The present device is particularly advantageous in the pressure moulding of highly reactive metals such as aluminium and magnesium, with injection of a suitable gas in a quantity dosed with precision.

The device thus described gives rise to a rapid pressure moulding method during which a constant vacuum is maintained in the crucible, so that immediately before the casting, the molten metal undergoes prolonged degassing leading to the removal of even the smallest bubbles during casting, the metal remaining perfectly protected from any outside action until it is cooled.

The device also enables the implementing of a rapid pressure moulding method leading to the injection in the mould, before the casting of the molten metal, of a predetermined quantity of an active gas having an effect at the surface of the part to be cast and being able for example to facilitate the unsticking thereof at the time of the opening of the mould or else leading to any other surface treatment of the part.

Although the devices which have just been described appear to afford the greatest advantages for implementing the invention, it will be understood that various modifications, particularly concerning the position of the vacuum pump and of the gas source, can be made thereto without going beyond the scope of the invention.

I claim:

1. In a method for rapid casting of molten metal comprising the step of pumping molten metal through an ascending pipe from a closed crucible containing molten metal by a pump at least partially immersed in said molten metal to an injection cylinder connected to a mold at a level above said crucible, and determining the level of molten metal in the injection cylinder by a level determining tank fluid connected by way of a return pipe to the crucible and to the ascending pipe, the improvement comprising: maintaining a common vacuum pressure above the molten metal within the crucible, the level-determining tank and the injection cylinder during pressure casting until at least the molten metal has cooled in the mold.

2. The method as claimed in claim 1, further comprising the step of subjecting degassed molten metal to the rapid action of an active gas at the time of injection of molten metal from the injection cylinder into the mold.

3. In a fluid-tight cold chamber pressure casting apparatus comprising:

a mold;

a crucible closed by a cover, said crucible adapted to contain molten metal during operation of the apparatus;

a pump for molten metal positioned to be at least partly immersed in said molten metal;

an ascending feed pipe rising from the molten metal pump;

a level-determining tank, means fluid connecting said level-determining tank to both a return pipe for returning the molten metal to the crucible and to the ascending feed pipe;

an injection cylinder connected to said feed pipe being supplied with molten metal and connected to the mold; the improvement comprising:

a vacuum pump, and means for commonly connecting said vacuum pump to the crucible, the level-determining tank and the injection cylinder for maintaining the same vacuum pressure above the molten metal within said crucible, said tank and said injection cylinder.

4. Apparatus for casting molten metal according to claim 1, wherein an input of the ascending pipe for bringing the molten metal into the injection cylinder is disposed opposite to the inlet of the pipe connecting the injection cylinder to the vacuum pump and a slidable piston means is adapted to block both pipes simultaneously immediately before the injection of the molten metal into the mold.

5. Apparatus for casting molten metal according to claim 4, wherein said piston means comprises a first piston for pushing the molten metal into the mold and a second piston integral with the first piston for ensuring the simultaneous blocking of the ascending pipe and of the vacuum pipe during molding as well as when the mold is open to remove a casting therefrom.

6. Apparatus for casting molten metal according to claim 5, wherein said piston is located relative to the vacuum and metal supply pipes and said mold such that the extraction of a casting is effected by withdrawal of a mobile part of the mold with the piston blocking the vacuum and metal supply pipes to preserve a reserve vacuum in the remainder of the apparatus which is immediately available for a subsequent casting operation.

7. Apparatus for casting molten metals according to claim 1, wherein the mould is connected to a gas source through a valve pipe.

* * * * *